United States Patent [19]

Heins et al.

[11] Patent Number: 4,861,177

[45] Date of Patent: Aug. 29, 1989

[54] RELOADABLE RIBBON CASSETTE SYSTEM

[75] Inventors: Hans-Peter Heins; Alfred Keiter, both of Wilhelmshaven; Hermann Jendricke, Varel, all of Fed. Rep. of Germany

[73] Assignee: AEG Olympia Aktiengesellschaft, Wilhelmshaven, Fed. Rep. of Germany

[21] Appl. No.: 157,201

[22] Filed: Feb. 18, 1988

[30] Foreign Application Priority Data

Feb. 18, 1987 [DE] Fed. Rep. of Germany ..... 3705057
Dec. 17, 1987 [DE] Fed. Rep. of Germany ..... 3742860

[51] Int. Cl.[4] ..... B41J 35/28

[52] U.S. Cl. ..... 400/208; 400/242; 400/238; 400/250; 400/235; 400/228

[58] Field of Search ..... 400/207, 208, 208.1, 400/242, 238, 250, 235, 236, 243, 244, 245, 246, 248, 228

[56] References Cited

U.S. PATENT DOCUMENTS 3,731,781 5/1973 Caudill et al. ..... 400/208
4,010,839 3/1977 Guerrin et al. ..... 400/208
4,413,919 11/1983 Applegate et al. ..... 400/208
4,440,514 4/1984 Keiter et al. ..... 400/208
4,780,010 10/1988 Behrens et al. ..... 400/208

*Primary Examiner*—Edgar S. Burr
*Assistant Examiner*—James R. McDaniel
*Attorney, Agent, or Firm*—Spencer & Frank

[57] ABSTRACT

A reloadable ribbon cassette system for typewriters or office machines of similar construction employs a bottom housing in which an exchangeable supply spool core for the ribbon and an exchangeable take-up spool core can be rotatably mounted. To facilitate the reloading process a cover plate is placed onto the top face of the ribbon coiled on the supply spool core, the cover plate inserted into the bottom housing member along with the supply spool core and ribbon when they are loaded. The cover plate has a contact surface for helping to steady a fastening element disposed at the free end of the ribbon during reloading. The cover plate projects beyond the ribbon coil at least in the region of the contact shelf to prevent accidental removal of the first few turns of the coiled ribbon in axial direction. The cover plate unequivocally gives a starting point for a guide pin which is detachably connected to the fastening element, the guide pin being used for threading the ribbon around a ribbon path to the take-up spool core.

18 Claims, 3 Drawing Sheets

RELOADABLE RIBBON CASSETTE SYSTEM

CROSS REFERENCE TO RELATED APPLICATION

The subject matter of the present application is related to that of an application filed concurrently herewith by Heinz Lange, Hans-Peter Heins, and Hermann Jendricke under Ser. No. 157,200, now U.S. Pat. No. 4,854,755, both the present application and the related application being owned by the same assignee.

BACKGROUND OF THE INVENTION

The present invention relates to a reloadable ribbon cassette system. More particularly, the invention relates to a ribbon cassette of the type which includes reloadable ribbon spools, in which a supply spool for unwinding the ribbon and a take-up spool for winding the ribbon up are rotatable mounted on bearing pins in the cassette, which includes a foldable cover provided with an opening, with the free end of the ribbon of the full supply spool being provided with a fastening element for threading the ribbon around reversal points in the cassette and for fastening to the core of the take-up spool.

U.S. Pat. No. 3,731,781 discloses a removable cassette for a carbon ribbon to be used in a printer having a rotatable drive element for ribbon advance, with the cassette being composed of a housing accommodating a ribbon supply spool and a take-up spool. A pivotal feed roller equipped with a sprocket wheel cooperates with a take-up spool disposed on a stationary axis to wind up the carbon ribbon. For exchanging the cassette, the feed roller and the sprocket wheel must first be put out of engagement with the take-up spool. This exchange process requires a plurality of manipulations since, after insertion of the new cassette in the receptacle of the machine, the feed roller must be brought back into engagement with the take-up spool.

U.S. Pat. No. 4,010,839 discloses a ribbon cassette for a typewriter or office machine of a similar construction in which the feed roller and its sprocket wheel are also disposed in the cassette. The feed roller remains in constant engagement with the carbon ribbon on the take-up spool. In this way it is possible to exchange ribbon cassettes with only one hand. This prior art ribbon cassette is very expensive since the members for driving the carbon ribbon contained in the ribbon cassette are discarded together with the ribbon when it is used up. Since, moreover, the feed roller is always in engagement with the take-up spool and the drive elements are mounted in the bottom portion and in the cover, which is fixed to the bottom portion, it is not possible to exchange the supply and take-up spools.

Additionally, U.S. Pat. No. 4,780,010, issued Oct. 25, 1988, discloses a ribbon cassette for office machines in which the supply and take-up spools are arranged to be exchangeable. This makes it possible to exchange only the ribbon spools if the ribbon is used up. The drawback of this cassette is that the ribbon can be threaded incorrectly within the cassette and interfere with the ribbon drive.

SUMMARY OF THE INVENTION

It is an object of the present invention to provide a ribbon cassette equipped with reloadable ribbon spools which ensure easy exchangeability of the ribbon spools and easy threading of the ribbon, whereupon the printing process can continue without interruption until the newly inserted ribbon is used up.

This and other objects which will become apparent in the ensuing detailed description can be attained by providing a reloadable ribbon cassette of the type mentioned in the introductory paragraph of this specification, the cassette being characterized in that a cover plate can be placed onto a free face of a supply spool inserted into the cassette, the cover plate has a contact shelf for a fastening element disposed at the free end of the ribbon of the supply spool, and the cover plate projects beyond the face of the supply spool at least in the region of the contact shelf so that removal of the first turns of the coiled ribbon in the axial direction is impossible.

The supply spool according to the preferred embodiment of the invention is connected with a cover plate made of cardboard. The cover plate serves as a securing means during transport when the spool is placed into the cassette and acts as a ribbon guide to protect it against inadvertent removal of the first turns in the axial direction. It also constitutes an insertion aid since it brings the supply spool and the fastening element into a position in the cassette from which the fastening element is positively guided in the intended direction.

DESCRIPTION OF THE PREFERRED EMBODIMENT

Figure 1:
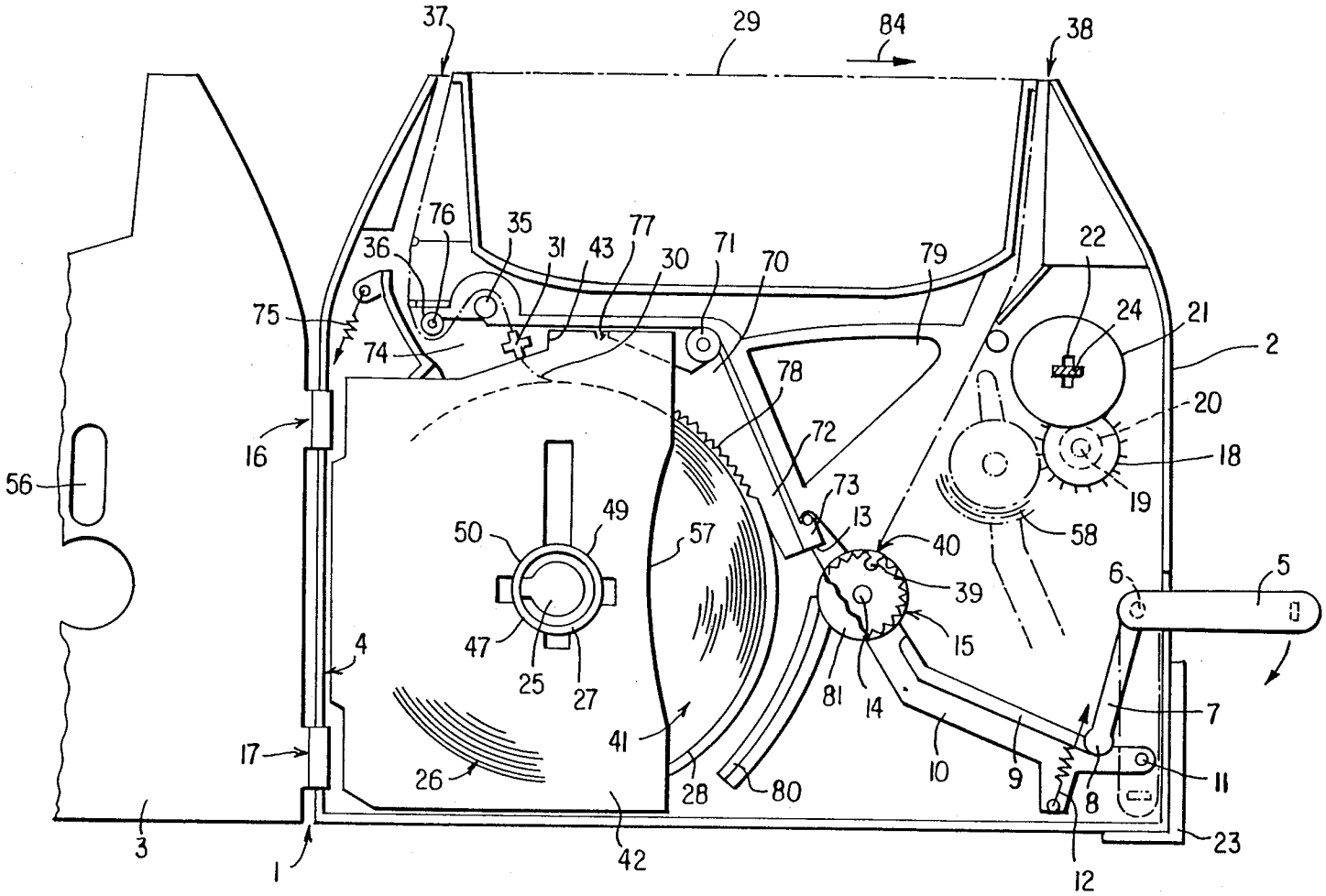
FIG. 1 is a top view showing the reloadable cassette with its cover open, a portion of the cover being broken away.

FIG. 1 shows a reloadable ribbon cassette 1 composed of a cup-shaped bottom member 2 and a cover 3 which closes the opening of bottom member 2. Cover 3 is articulated to the side wall 4 of bottom member 2 and can be releasably latched to the bottom member 2 by a catch lever 5, which is pivotal about an axis 6 in the bottom member 2. Such releasable latching can be accomplished by providing a latch opening (not illustrated) in cover 3, the latch opening being positioned so that catch lever 5 overlaps the outer surface of cover 3 when the latter is closed and catch lever 5 is rotated to the position shown in dotted lines, an so that catch lever 5 is clear of cover 3 when it is positioned as shown in solid lines. Catch lever 5 has a control arm 7 whose free end 8 is in slidable form-locking engagement with the guide face 9 of a pivot lever 10. That is, the underside of free end 8 has spaced-apart projections (not illustrated) between which guide face 9 extends, thereby slidably retaining free end 8 in a channel between the projections. Pivot lever 10 is biassed clockwise about an axis 11 by a spring 12, which extends over guide face 9 and is positioned so as not to interfere with the movement of control arm 7. Inward of an abutment 13 at the end of pivot lever 10, a take-up spool core 15 is mounted so as to be rotatable about a bearing pin 14 extending from pilot lever 10. In FIG. 1 a portion of spool core 15 is broken away to permit illustration of contact surface 81, which will be discussed later.

In FIG. 1, when catch lever 5 is in the pivoted-out position as shown in solid lines, cover 3 is released and is freely pivotal into the open or closed position about hinges 16 and 17. In this position of catch lever 5, take-up spool core 15 is also held out of engagement with teeth 18 extending from a feed roller 19. Feed roller 19 is fixed to a gear 20 which is in constant engagement with a drive gear pinion 21 (which, although not illustrated in FIG. 1, has gear teeth which mesh with corresponding teeth on gear 20). When catch lever 5 is in the pivoted-in position shown in dotted lines, pilot lever 10 carries spool core 15 toward the right as illustrated in dotted lines, so that the teeth 18 of feed roller 19 resiliently engage spool core 15 or ribbon that has already been wound onto spool core 15. This resilient engagement with the teeth 18 of rotating feed roller 19 causes spool core 15 to also rotate, thereby winding more ribbon onto it. Drive pinon 21 has a cross-shaped slit 22 which can be coupled in a form-locking manner with a cutting edge 24 drivably mounted in receptacle 23.

Figure 4:
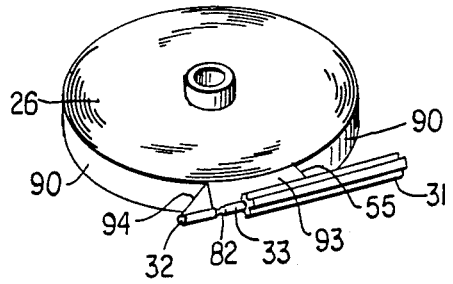
FIG. 4 is a perspective view showing a supply spool and guide pin.
Figure 5:
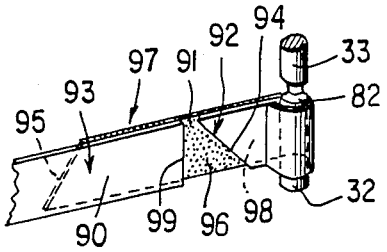
FIG. 5 is a perspective view showing a detail of FIG. 4.

With reference next to FIGS. 1, 4, and 5, bottom member 2 has a further bearing pin 25 for a supply spool 26 on whose core 27 there is disposed a supply coil 28 of an inked ribbon 30. A guide pin 31 has a projection 33 which is detachably connected to a fastening element 32 which, for example, has a cylindrical shape. As will be discussed in more detail later, detachable connecting element 32 is taped to the free end of ribbon 30. It will be understood in the present application that the "free end" of the ribbon refers either to the end of the ribbon 30 itself, if it is not connected to a leader, or to the end of the leader if one is used. With the aid of guide pin 31, ribbon 30 can be manually pulled along a ribbon path 29 (shown with a dot-dash line) which extends around guide pin 35 and guide roller 36, out of exit opening 37 and into entrance opening 38, and to take-up spool core 15. To attach ribbon 30 to take-up spool core 15, core 15 is provided with a receiving bore 39 for the fastening element 32 and slit 40 for passage of ribbon 30. After fastening element 32 has been lodged in receiving bore 39, it is broken away from projection 33 of guide pin 31.

Figure 2:
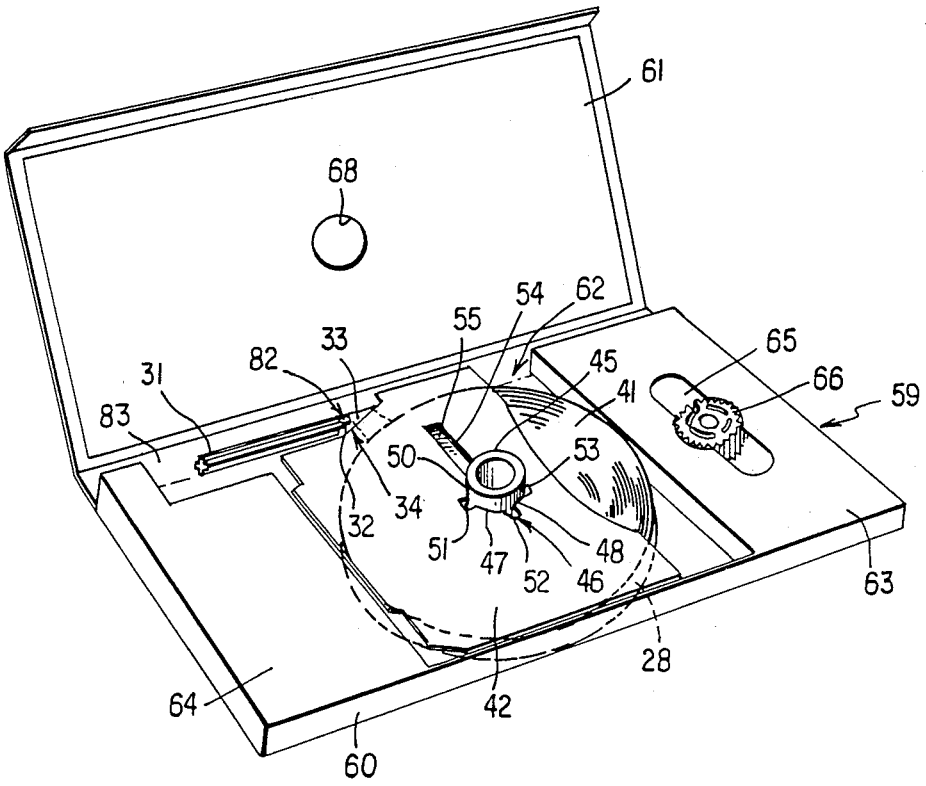
FIG. 2 is a perspective view showing a supply spool and cover plate in an open shipping package.

With reference next to FIGS. 1 and 2, a cover plate 42 is placed onto the top face 41 of supply spool 26, and is inserted along with supply spool 26 into cassette 1. Cover plate 42 projects beyond top face 41 of supply spool 26, at least in the region of a contact shelf 43, so that removal of the first turns of supply coil 28 of ribbon 30 is blocked in the axial direction as supply coil 28 is being transferred to cassette 1 for loading. That is, contact shelf 43 is positioned at the free end of ribbon 30 before loading and provides a support against which fastening element can be held during the transfer to cassette 1, thereby helping to steady fastening element 32 in the hands of the person who is loading cassette 1. Cover plate 42 is additionally provided with an outer contour which corresponds to the inner contour of cassette 1 so that, after supply spool 26 has been inserted into cassette 1, cover plate 42 is mounted so as to be secured against rotation. Core 27 of supply spool 26 is provided with a handle 45 having a hollow cylindrical configuration. Handle 45 projects with respect to top face 41 of supply coil 28, with cover plate 42 being arranged so as to be engageable on this handle 45. For this purpose, cover plate 42 is provided with a recess 46 having inwardly projecting centering tabs 47, 48, 49, and 50 for mounting in a centered position on the handle 45. Between these individual centering tabs 47, 48, 49 and 50, cutouts 51, 52, 53, 54 are arranged so as to be radially aligned. Cutout 54 is elongated to provide an extended recess 55 which serves as a viewing slit and, if the cover 3 is closed, is disposed flush with a viewing slit 56 in cover 3.

In order to realize a compact configuration of the ribbon cassette 1, cover plate 42 is provided with a recess 57 for coil 58 on take-up spool core 15. The full coil 58 on take-up spool core 15 then projects into recess 57 of cover plate 42. For that reason, recess 57 is constructed to be concave with respect to the core 27 of supply spool 26.

Supply spool 26 and cover plate 42 together form an exchangeable unit which, for shipping, is arranged in a package 59 as shown in FIG. 2. Package 59 is composed of a box-shaped bottom member 60 and a cover 61 for closing it. The box-shaped bottom member 60 is provided with a recess 62 to accommodate the exchangeable unit and with raised surfaces 63 and 64 on both sides of recess 62, the height of raised surfaces 63 and 64 corresponding to the width of the ribbon, with cavities being disposed therebelow. Raised surface 63 is provided with a recess 65 to store an exchangeable replacement core 66 for take-up spool core 15. Moreover, package 59 is composed of a foldable box made of cardboard which can be manufactured automatically. Instructions for insertion of the supply spool 26 and the take-up spool 15 may be printed on the interior of cover 61.

Figure 3:
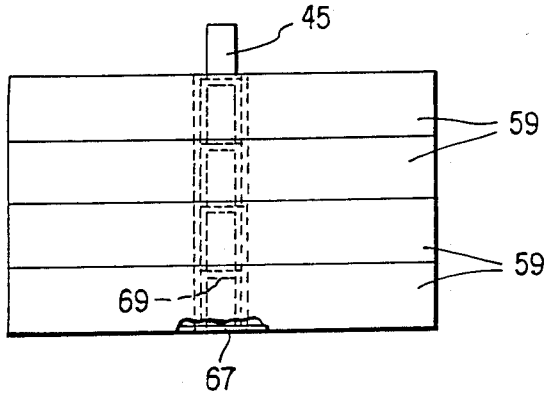
FIG. 3 is a side view showing a stack of several shipping packages.

Referring next to FIGS. 2 and 3, bottom member 60 and cover 61 are provided respectively with circular recesses 67 and 68 for handle 45. The handle 45 of a supply spool 26 projecting from one package 59 extends through a recess 67 in the bottom member 60 of a second package 59 and into a recess 69 in the core 27 of the supply spool 26 disposed in the second package 59. This ensures secure stacking of several packages 59 on top of one another.

Pivot lever 10 (FIG. 1) has a circular contact surface 81 concentric with bearing pin 14 for take-up core 15. Contact surface 81 limits the insertion of fastening element 32. After insertion, guide pin 31 is separated from fastening element 32 by breaking it off at a notch 82 (see FIG. 5). In package 59 (FIG. 2), guide pin 31, which serves as a handle as previously explained, rests in a recess in bottom member 60.

Returning to FIG. 1, the coil 58 on take-up spool 15 is supported as its diameter increases on raised surfaces 79 and 80 in bottom member 2. These surface ar arranged in the vicinity of the circumference of a toothed blocking disc 78, which rotates together with the supply spool 26. Although teeth are illustrated on only a portion of the periphery of blocking disc 78 in FIG. 1, this has been done merely to simplify the drawing and it will be understood that in practice teeth extend all the way around the periphery of blocking disc 78. A blocking tooth 77 of a blocking lever 70, which is biassed by a spring 75, can be brought into engagement with the teeth of blocking disc 78. Blocking lever 70 is pivotal about an axis 71 in bottom member 60 and has two arms 72 and 74. A bearing pin 76 for guide roller 36, which is configured as a ribbon reversal point, is disposed on arm 74 of blocking lever 70. The second arm 72 of blocking lever 70 has an abutment face 73 which is positioned for engagement by abutment arm 13 of pivot lever 10. If catch lever 5 is pivoted out into the position shown in solid lines in FIG. 1, pivot lever 10 is pivoted counterclockwise about axis 11 and, by way of its abutment arm 13, pivot lever 70 is pivoted clockwise about bearing axis 71. This causes coil 58 of ribbon that has been wound onto take-up spool core 15 to go out of engagement with the teeth 18 of feed roller 19 and blocking tooth 77 to go out of engagement with the teeth of toothed blocking disc 78. When pivot lever 10 again takes up the position shown in dotted lines in FIG. 1, spring 12 causes coil 58 to again lie resiliently against teeth 18 of feed roller 19. Additionally, blocking tooth 77 is again engaged with the teeth of blocking gear 78. If feed roller 19 is driven by drive gear pinion 21, take-up spool core 15 is turned clockwise, thus moving ribbon 30 by one step in the direction of arrow 84. The increasing tension in ribbon 30 causes blocking lever 70 to be pivoted clockwise, thus bringing blocking tooth 77 out of engagement with the teeth of blocking gear 78. This releases supply spool 26 for unwinding. As soon as the tension in ribbon 30 decreases, blocking lever 70 at once returns to its blocking position. Since, with increasing diameter, the coil 58 on the take-up spool core 15 is supported on raised surfaces 79 and 80, the rotary movement of blocking gear 78, upon its release by blocking tooth 77, is not interfered with. The height of raised surfaces 79 and 80 is such that the coil 58 does not touch blocking gear 78.

FIGS. 4 and 5 show how guide pin 31 is connected to a leader 90 for ribbon 30. For this purpose, a piece of adhesive tape 91 is employed. Tape 91 is provided with adhesive on one side and is cut without waste from a roll of adhesive tape (not illustrated). The two ends 92 and 93 of the piece of adhesive tape 91 have cut edges 94 and 95 which slope at an angle of 45° in opposite directions. After the end 92 of the piece of adhesive tape 91 has been looped around connecting element 32 of guide pin 33, and the other end 93 of the piece of adhesive tape 91 has been fastened to leader 90, an adhesive region 96 remains which has an essentially triangular shape. Assuming that leader 90 has a perpendicular edge 99, the hypotenuse of the triangle forms an angle of 45° with its base. The remaining triangular adhesive region 96 between the end 92 of the piece of adhesive tape 91 and the perpendicularly cut leader 90 thus glues the leader end 97 and guide pin 31 securely to the outer turn of supply spool 26. Adhesive region 96 can easily be torn off so that guide pin 31 can be used to pull ribbon 30 to take-up spool core 15 as previously discussed. The adhesive surface 96 is sufficiently small that, as ribbon 30 is being threaded, hardly any adhesive residues form at guide pin 35 and guide roller 36 (FIG. 1), or other points of contact along ribbon path 29, which could result in later malfunctions in the ribbon transport.

A great advantage of the sloped cut edge 94 and thus the triangular adhesive connection region 98 at the end 92 of piece of adhesive tape 91 is that, when the flat supply spool 26 is packed in package 59 (FIG. 2), the glued-on guide pin 33 automatically assumes a position at the bottom in a recess 83. In this way, there is no additional stress on the adhesive connection along edge 94 at end 92.

Insertion of fastening element is additionally facilitated considerably without the attached adhesive surfaces of the piece of adhesive tape 91 even partially coming loose.

The present disclosure relates to the subject matter disclosed in Federal Republic of Germany patent application Nos. P 37 05 057.5 and P 37 42 860.8, of Feb. 18, 1987 and Dec. 17, 1987 respectively, the entire specifications of which are incorporated herein by reference.

It will be understood that the above description of the present invention is susceptible to various modifications, changes and adaptations, and the same are intended to be comprehended within the meaning and range of equivalents of the appended claims.

Figure 6:
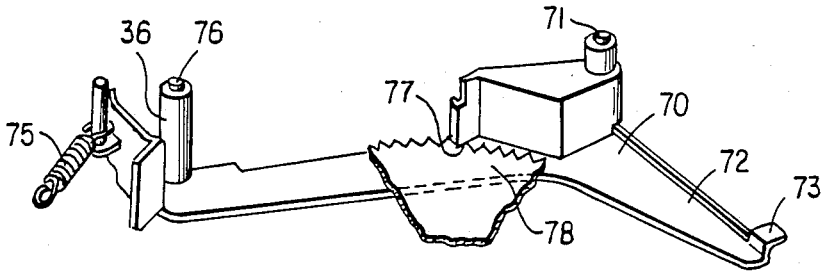
FIG. 6 is a perspective view showing a blocking lever and a segment of a toothed blocking disc.

FIG. 6 shows the blocking lever 70 in a perspective view. Hereby, the tooth of the blocking lever 70 is engaged with the teeth of the blocking gear 78 which is coupled with the supply spool 26. If blocking lever 70 is pivoted clockwise about axis 71, the tooth 77 goes out of engagement with the teeth of blocking gear 78.

Figure 7:
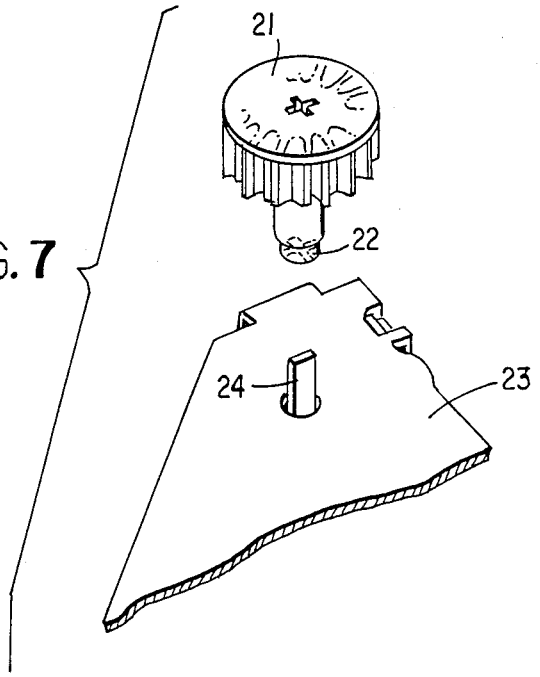
FIG. 7 is a perspective view showing receptacle with cutting edge drivable by a not shown motor.

Furthermore, FIG. 7 shows the cutting edge 24 on the receptacle which is drivable by a not shown motor in a well known manner. When the ribbon cassette is positioned on the receptacle 23, the cutting edge 24 will be automatically coupled with the cross-shaped slit 22 of the drive pinion 21.

What we claim is:

1. A reloadable ribbon cassette system, comprising:

a bottom member;

a foldable cover for the bottom member;

a reloadable supply spool core;

a ribbon having an end, the ribbon initially being wound on the supply spool core in a coil, the coil having a coil face;

a bearing pin to receive the supply spool core and rotatably mount the supply spool core in the bottom member;

a reloadable take-up spool core for the ribbon;

another bearing pin to receive the take-up spool core and rotatably mount the take-up spool core in the bottom member;

means in the bottom member for defining a plurality of ribbon reversal points;

fastening element means at the end of the ribbon for fastening the ribbon to the take-up spool core after the ribbon has been threaded around the ribbon reversal points; and a cover plate on the coil face of the ribbon wound on the supply spool core, the cover plate having a contact shelf for the fastening element means at the end of the ribbon when the ribbon is wound entirely on the supply spool core, the cover plate projecting beyond the coil face at least in the region of the contact shelf to prevent removal of the first few turns of the coil in the axial direction.

2. The reloadable ribbon cassette system of claim 1, wherein the bottom member has an inner contour, and wherein the cover plate has an outer contour which corresponds to the inner contour to secure the cover plate against rotation after the supply spool core has been received by the bearing pin.

3. The reloadable ribbon cassette system of claim 1, wherein the supply spool core has a handle which projects from the coil face, the cover plate frictionally engaging the handle to secure the cover plate to the handle.

4. The reloadable ribbon cassette system of claim 3, wherein the handle has a hollow cylindrical shape, and wherein the cover plate has a recess and inwardly projecting centering tabs at the recess for engagement with the handle.

5. The reloadable ribbon cassette system of claim 4, wherein the recess includes radially disposed cutouts between the centering tabs.

6. The reloadable ribbon cassette system of claim 5, wherein the foldable cover has a viewing slit, and wherein one of the cutouts is elongated and is aligned with the viewing slit when the cover is closed.

7. The reloadable ribbon cassette system of claim 1, wherein the cover plate has an edge which faces the take-up spool core, the edge having a recess to accommodate ribbon wound on the take-up spool core.

8. The reloadable ribbon cassette system of claim 7, wherein the recess is concave.

9. The reloadable ribbon cassette system of claim 1, further comprising a toothed blocking disc connected with the supply spool core, and wherein the bottom member is provided with raised surfaces to support ribbon wound on the take-up spool core, the raised surfaces being disposed outside the blocking disc and adjacent the periphery of the blocking disc.

10. The reloadable ribbon cassette system of claim 1, wherein the supply spool core together with the ribbon wound thereon and the cover plate comprise an exchangeable unit.

11. The reloadable ribbon cassette system of claim 10, further comprising a package for the exchangeable unit before the exchangeable unit is installed in the bottom member, the package including a box-shaped bottom portion having a recess for receiving the exchangeable unit, raised surfaces on either side of the recess, the raised surfaces being disposed above cavities and having a height corresponding to the width of the ribbon, one of the raised surfaces having a further recess for accommodating a take-up spool core, the package additionally including a planar cover for closing the bottom portion.

12. The reloadable ribbon cassette system of claim 11, wherein the supply spool core has a cavity therein and has a handle which projects from the coil face, and wherein the cover of the package has a hole for the handle and the bottom portion of the package has a hole communicating with the cavity in the supply spool core so that packages containing respective exchangeable units can be stacked, with the handle of one supply spool core extending out of the respective package and into the cavity of a supply spool core in an adjacent package.

13. The reloadable ribbon cassette system of claim 11, wherein the package is a folded cardboard box.

14. The reloadable ribbon cassette system of claim 10, wherein the ribbon comprises a leader and the end of the ribbon is a leader end, and wherein the fastening element means comprises a guide pin and a piece of adhesive rape having longitudinal edges and having first and second ends, the second end of the tape being cut an oblique angle to the longitudinal edges, the piece of tape being looped around the fastening element with the first end of the piece of rope being attached to the leader and the second end of the piece of tape being attached to the adhesive surface of the piece of tape at a triangular connection region.

15. The reloadable ribbon cassette system of claim 14, wherein the leader end is cut perpendicular to the leader, and wherein the triangular connection region is disposed so that the adhesive tape retains an exposed adhesive surface of triangular configuration, between the leader end and the connection region, for attachment to the last turn of the ribbon coiled on the supply spool core.

16. The reloadable ribbon cassette system of claim 14, wherein the first end of the piece of adhesive type is cut at an oblique angle to the longitudinal edges, the oblique angles at both the first and second ends of the piece of adhesive tape being substantially 45° so that a sequence of pieces of adhesive tape can be cut without waste from a roll of adhesive tape.

17. The reloadable ribbon cassette system of claim 1, further comprising a blocking disk connected to the supply spool core, the coil of ribbon which is initially wound on the supply spool core being sandwiched between the blocking disk and the cover plate.

18. The reloadable ribbon cassette system of claim 1, wherein the take-up spool core has an opening therein, and wherein the fastening element means comprises a member connected to the end of the ribbon, the member being configured for manual insertion into the opening in the take-up spool core and being initially positioned adjacent the contact shelf of the cover plate.

* * * * *